US007036520B2

(12) United States Patent
Pearson, Jr.

(10) Patent No.: US 7,036,520 B2
(45) Date of Patent: May 2, 2006

(54) HOT WATER HEATER RECIRCULATION SYSTEM AND METHOD

(76) Inventor: Kenneth W. Pearson, Jr., 4813 S. Quinimose Rd., Liberty Lake, WA (US) 99019

( * ) Notice: Subject to any disclaimer, the term of this patent is extended or adjusted under 35 U.S.C. 154(b) by 0 days.

(21) Appl. No.: 10/783,436

(22) Filed: Feb. 19, 2004

(65) Prior Publication Data

US 2005/0183778 A1 Aug. 25, 2005

(51) Int. Cl.
*E03B 7/07* (2006.01)

(52) U.S. Cl. ..... 137/1; 137/563; 137/337; 137/565.01; 417/32; 126/362.1

(58) Field of Classification Search ..... 137/563, 137/337, 566, 565.01, 1; 417/32; 126/362.1
See application file for complete search history.

(56) References Cited

U.S. PATENT DOCUMENTS

| | | | | |
|---|---|---|---|---|
| 4,201,518 A | | 5/1980 | Stevenson | 417/12 |
| 4,687,948 A | * | 8/1987 | Helt | 307/38 |
| 4,960,080 A | * | 10/1990 | O'Neill et al. | 123/25 A |
| 5,205,318 A | | 4/1993 | Massaro et al. | 137/337 |
| 5,261,443 A | | 11/1993 | Walsh | 137/337 |
| 5,277,219 A | * | 1/1994 | Lund | 137/337 |
| 5,735,291 A | | 4/1998 | Kaonohi | 137/337 |
| 5,775,372 A | * | 7/1998 | Houlihan | 137/337 |
| 5,829,467 A | | 11/1998 | Spicher | 137/14 |
| 5,829,475 A | | 11/1998 | Acker | 137/337 |

OTHER PUBLICATIONS

RIB®, Functional Devices, Inc., Catalog A600C 2005, 136 pages + cover page.
RIB®, Functional Devices, Inc., RIBXLCA, Enclosed Internal Adjustable .50-10 Amp Current Sensor . . . , 1 page.
ABB Inc., AC Current Sensor, PLC Interface Module, Low Voltage Products & Systems, pp. 8.8-8.9.
R. Dickinson et al., "*Isolated Open Loop Current Sensing Using Hall Effect Technology in an Optimized Magnetic Circuit*", Allegro MicroSystems, Inc., Jul. 11, 2002, pp. 1-12.

* cited by examiner

*Primary Examiner*—Kevin Lee
(74) *Attorney, Agent, or Firm*—Wells St. John P.S.

(57) ABSTRACT

A hot water recirculation system includes a source of hot water, a fixture, a fluid circuit, a fluid pump, and an electrical circuit sensor. The fixture is remote from the source of hot water and is configured to dispense hot water. The fluid circuit extends from the source to the fixture for delivering hot water to the fixture. The fluid circuit returns to the source for recirculating hot water in the fluid circuit back to the source for reheating. The fluid pump is configured for recirculating hot water through the fluid circuit. The electrical circuit sensor is configured to detect operation of an electrical circuit proximate the fixture and associated with a user operating the fixture. The electrical circuit sensor is further configured to initiate operation of the fluid pump responsive to detected operation of the electrical circuit to initiate hot water recirculation. A method is also provided.

25 Claims, 2 Drawing Sheets

10
12
14
16
18
20
22
24
25
26
28
30
32
34
36
38
39
40
41
42
44
46
47
48
50
51
52
53
54
56
58
60
63
64
65
66
67
68
70
72
74
76
78
80
82
COLD
HOT
II

HOT WATER HEATER RECIRCULATION SYSTEM AND METHOD

TECHNICAL FIELD

The present invention pertains to hot water supply and heating systems that conserve water and energy. More particularly, the present invention relates to hot water recirculation systems.

BACKGROUND OF THE INVENTION

Numerous hot water recirculation systems are known to exist for delivering hot water to a fixture within a building. The water is recirculated in order to make hot water instantly available at the fixture when the fixture is turned on. Also, hot water is recirculated in order to conserve water usage because unrecirculated water is typically delivered down a drain while an operator of a fixture waits for hot water to reach the fixture.

U.S. Pat. No. 4,201,518 discloses one system for recirculating hot water. Manually operated push button switches are wired into positions adjacent to hot water fixtures, or taps, within a house. The push buttons operate a time delay circuit that turns on a recirculation pump for a set time interval to circulate hot water through the system. However, electrical wiring must be run from each hot water tap in the system to a central control circuit for a recirculation pump. Since hot water taps are distributed throughout a building or home, this can entail a significant amount of wiring. Furthermore, dedicated push button switches need to be wired into locations adjacent each hot water tap. This entails further expense and complexity in installing the system. Furthermore, the use of dedicated push button switches requires that a user manually activate the push button switch in order to initiate hot water recirculation for the respective hot water tap, which requires that a user remember to turn on the switch.

U.S. Pat. No. 5,205,318 discloses another hot water recirculation system. This system uses a cold water line, or pipe, in combination with a hot water line to recirculate hot water. The system is placed near a hot water fixture. The system pulls water from the hot water line and places it into the cold water line until water in the hot water line reaches a set temperature. However, this makes water in the cold water line warm or hot. Additionally, temperature in the cold water line now varies greatly, and this may require that a user needs to aggressively and continuously adjust the fixture in order to realize a desired water temperature at the fixture, as temperature in the cold water line varies. Furthermore, cold water will be wasted at the fixture in order to obtain cold water at the fixture, and hot water that enters the cold water line can end up at other cold water fixtures. Even furthermore, power needs to be installed adjacent to the system, or unit, which is near the fixture. The system is also prone to failure due to accumulation of hard water deposits that can cause the system to stick into an open position, thereby wasting hot water and sending hot water to all the cold water outlets throughout the system.

SUMMARY OF THE INVENTION

A hot water recirculation system is provided that reduces complexity and cost of installation, while also eliminating the need that a user remember to physically trigger initiation of hot water recirculation before using a hot water fixture.

The system uses existing electrical wiring to detect a need to initiate hot water recirculation. Secondly, the system uses existing electrical switches that accompany usage of the fixture, such as an overhead light or a power switch for a device that has the fixture.

According to one aspect, a hot water recirculation system includes a source of hot water, a fixture, a fluid circuit, a fluid pump, and an electrical circuit sensor. The fixture is remote from the source of hot water and is configured to dispense hot water. The fluid circuit extends from the source to the fixture for delivering hot water to the fixture. The fluid circuit returns to the source for recirculating hot water in the fluid circuit back to the source for reheating. The fluid pump is configured for recirculating hot water through the fluid circuit. The electrical circuit sensor is configured to detect operation of an electrical circuit proximate the fixture and associated with a user operating the fixture. The electrical circuit sensor is further configured to initiate operation of the fluid pump responsive to detected operation of the electrical circuit to initiate hot water recirculation.

According to another aspect, a system is provided for initiating hot water recirculation. The system includes a hot water tank, a hot water fixture, a hot water fluid conduit, a hot water pump, and an electrical power relay. The hot water tank has a hot water heater. The hot water fixture is disposed from the hot water tank and is configured to dispense hot water to a user. The hot water fluid conduit includes a hot water pipe loop extending from the hot water tank to the fixture and back to the hot water tank to enable passage of hot water in a single direction through the fluid conduit to the fixture and back to the hot water tank for reheating. The hot water pump is disposed in the fluid conduit downstream of the fixture and proximate the hot water tank. The hot water pump is configured to recirculate hot water through the fluid conduit and back into the hot water tank for reheating. The electrical power relay is configured to detect current flow through an electrical power circuit for a fixture that is proximate and associated with the hot water fixture. The electrical power relay is further configured to initiate power delivery to the hot water pump responsive to the relay detecting operation of current flow through the electrical circuit to initiate hot water recirculation.

According to yet another aspect, a method is provided for recirculating hot water through a continuous loop fluid circuit, which includes providing a source of hot water disposed within a continuous loop fluid conduit with at least one fixture disposed along the fluid conduit; detecting operation of an electrical circuit proximate the fixture and associated with a user operating the fixture, in response to detecting operation of the electrical circuit, recirculating hot water through the fluid conduit.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Reference will now be made to a preferred embodiment of Applicant's invention in the form of a hot water recirculation system. While the invention is described by way of a preferred embodiment, it is understood that the description is not intended to limit the invention to such embodiments, but is intended to cover alternatives, equivalents, and modifications which may be broader than the embodiments, but which are included within the scope of the appended claims.

In an effort to prevent obscuring the invention at hand, only details germane to implementing the invention will be described in great detail, with presently understood peripheral details being incorporated by reference, as needed, as being presently understood in the art.

Figure 1:
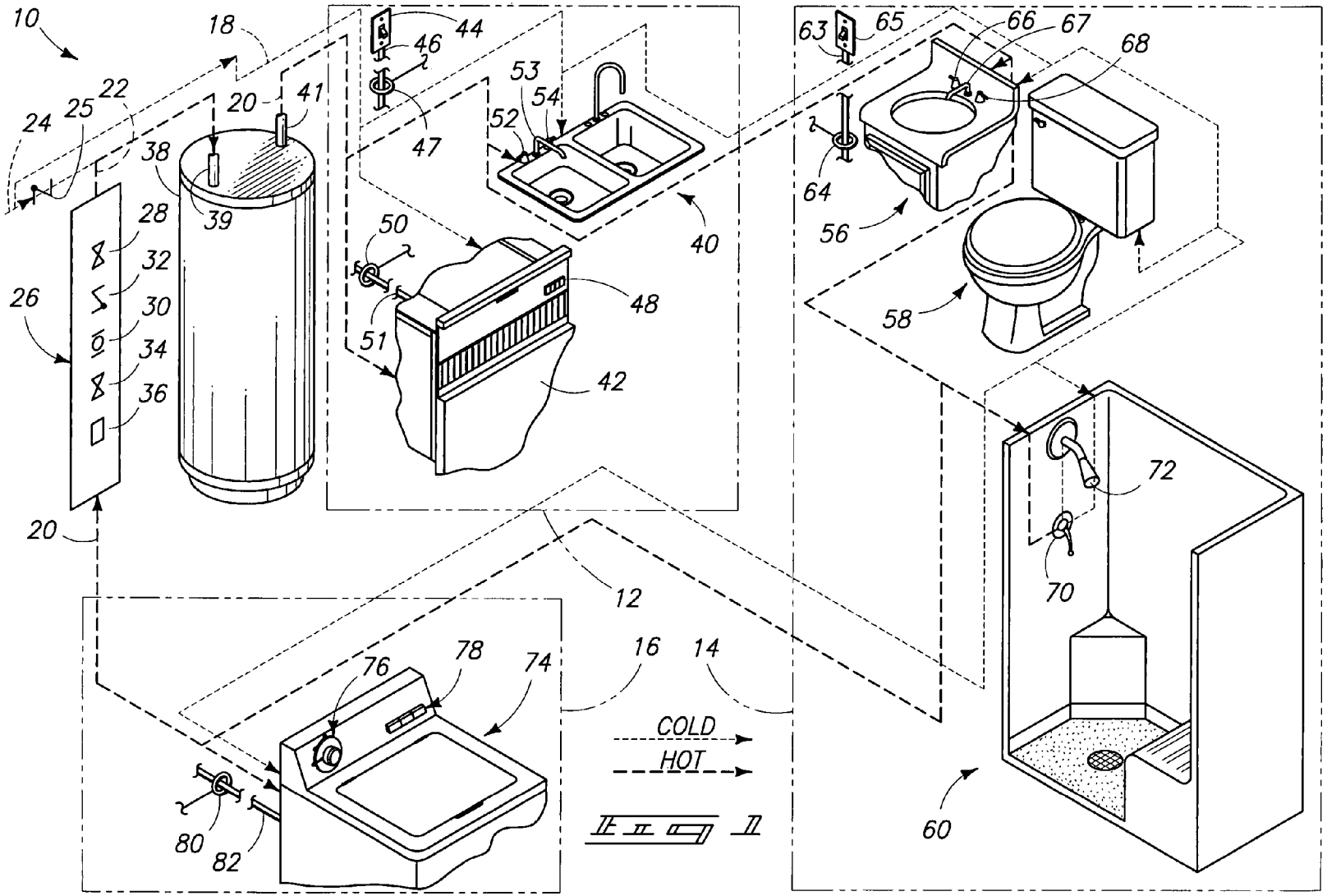
FIG. 1 is a simplified diagrammatic representation with parts broken away and illustrating a first embodiment of the present invention installed in a residential home.

FIG. 1 illustrates a hot water recirculation system identified by reference numeral 10. System 10 is implemented within a building, such as a residential home, to deliver recirculated hot water to selected hot water fixtures that are distributed about the home. However, it is understood that system 10 can be implemented within any building or any environment having a hot water delivery system.

For example, hot water is delivered to fixtures within a kitchen 12, a bathroom 14 and a laundry room 16 via a hot water supply line, or pipe, 20 that forms a continuous loop through the home. Hot water supply line 20 is configured in a continuous loop in order to enable recirculation of hot water therein. Cold water is delivered to fixtures within kitchen 12, bathroom 14, and laundry room 16 via a cold water supply line 18.

As shown in FIG. 1, a supply of hot water is generated within a hot water tank 38 via a gas-fired heater or electric heating elements (not shown) of tank 38. Hot water supply line 20 receives hot water from tank 38 via a hot water outlet fitting 41, and recirculates water from within line 20 back into tank 38 via a water inlet fitting 39 for reheating. Hot water supply line 20 provides a return line 22 for recycling water from line 20 back into tank 38 by passing the water into a main water supply line 24, downstream of a one-way check valve 25. Cold water supply line 18 branches off main water supply line 24 upstream of check valve 25. Check valve 25 provides one-way flow of water toward tank 38 and prevents water in line 20 from being delivered upstream into line 24 which would otherwise introduce heated water into cold water supply line 18.

A recirculation control system 26 is provided by system 10 for controlling movement of water within hot water supply line 20. More particularly, system 26 includes a shutoff valve 28 (optional), a water recirculation pump 30, a check valve 32, a shutoff valve 34 (optional), and a thermal switch 36 (optional). Shutoff valves 28 and 34 can be used to close line 20 on either side of pump 30. In this manner, line 20 can be shut off on both sides of pump 30, which enables removal and replacement of pump 30 during regular maintenance or repair. Additionally, either one of valves 28 and 34 can be used to close down line 20 when it is desired to disable recirculation features of the present invention. Check valve 32 allows one-way flow of water toward tank 38. Optionally, the locations of pump 30 and check valve 32 can be interchanged. Similarly, check valve 25 allows one-way flow of water toward tank 38.

According to one construction, water recirculation pump 30 comprises a gear rotor pump. Alternatively, pump 30 comprises a centrifugal pump, an impeller pump, a diaphragm pump, or any other pump suitable for pumping water in a single direction through a line or pipe circuit, or loop.

As shown in FIG. 1, shutoff valves 28 and 34 are optional and one or both can be removed in an alternative implementation. Furthermore, thermal switch 36 is also optional. However, thermal switch 36 can be used to detect a desired setpoint temperature at the downstream end of the hot water loop provided by line 20. If the temperature at the downstream end of line 20 does not drop below a desired setpoint (as detected by thermal switch 36), the recirculation system can be prevented from turning back on and initiating recirculation of hot water through line 20.

As shown by the implementation of hot recirculation system 10 within a home or building, various hot water fixtures are distributed about rooms 12, 14, and 16 within a house such that all hot water fixtures are presented in series along a loop provided by hot water line 20 as line 20 passes circuitously through the house and back to hot water tank 38. As shown in FIG. 1, system 10 is activated when power is used by devices that are associated with the hot water fixture present in a respective room. For example, when an overhead light is turned on by light switch 44 within kitchen 12, a relay 47 detects current flow through an electrical line 46 associated with light switch 44. Preferably, relay 47 is actually mounted about electrical line 46 where line 46 passes within a fuse box 88 (see FIG. 2). Alternatively, relay 47 can be mounted anywhere between switch 44 and fuse box 88 (of FIG. 2). In this manner, when lights are turned on in the kitchen, hot water circulation is implemented within line 20. This action will ensure that hot water will be more quickly available to a user when the user subsequently opens hot water faucet 52 to deliver hot water via spout 53 into the kitchen sink 40. Additionally, the initiation of hot water recirculation via line 20, resulting from turning on of switch 44, also presents hot water to a dishwasher 42 present within the kitchen 12. However, an additional trigger is rendered for initiating hot water recirculation for dishwasher 42, in the event that the kitchen light is not turned on. More particularly, a second relay 50 is provided about an electrical line 51 that supplies power to operate dishwasher 42. When an operating switch 48 is used to turn on dishwasher 42, relay 50 detects electrical current flow through electrical line 51 and thereby initiates operation of pump 30 and imparts hot water recirculation through line 20. Again, relay 50 is preferably mounted within fuse box 88 of FIG. 2. Alternatively, relay 50 can be mounted anywhere along electrical line 51 which is wired to provide power to dishwasher 42. Hence, relay 50 detects power consumption by dishwasher 42 when dishwasher 42 is initially turned on.

Also shown in FIG. 1, cold water supply line 18 provides cold water in series with each of the appliances present within kitchen 12, bathroom 14, and laundry room 16. For example, the cold water faucet 54 is used to turn on and off a cold water supply to spigot 53 in kitchen sink 40. Likewise, a cold water faucet 68 is used to turn on and off a supply of cold water from line 18 through a spigot 67 of a bathroom vanity sink 56. Furthermore, a hot/cold water faucet 70 is provided within a shower 60 of bathroom 14 to supply cold water (or a mixture of cold and hot water) via a showerhead outlet 72. Line 18 also supplies cold water to toilet 58 within bathroom 14. Even furthermore, line 18 provides a supply of cold water to clothes washer 74 within laundry room 16.

As shown within bathroom 14 of FIG. 1, a bathroom light switch 65 is turned on by a user of bathroom 14, which triggers hot water recirculation through line 20 to provide hot water to bathroom vanity sink 56 and shower 60. More particularly, electrical wire 63 is encircled by a relay 64 that detects current flow when switch 65 is turned on in order to turn on an overhead bathroom light fixture (not shown). Relay 64 monitors current flow through electrical wire 63, which then closes a circuit that turns on operation of pump 30 in order to initiate hot water recirculation through the closed loop provided by hot water line 20.

In the case of bathroom vanity sink 56, a hot water faucet 66 is turned on in order to deliver the recirculated hot water via spigot 67 into sink 56. Likewise, by rotatably positioning hot/cold water faucet 70 in shower 60 to a position that requires hot water, recirculated hot water is delivered through showerhead outlet 72 and into shower 60.

As shown in laundry room 16 of FIG. 1, clothes washing machine 74 includes power circuitry that is used to turn on washing machine 74 when a user desires to wash a load of clothes therein. More particularly, a timing/operation switch 76 enables initiation of a wash cycle by washing machine 74 when a user turns on switch 76. Mode switches 78 enable a user to vary the intensity or duration of the operating mode selected by a user for washing machine 74. Washing machine 74 receives power via an electrical wire 82 such that current is detected by a relay 80 when the washing machine cycle is turned on by selectively activating switch 76. Accordingly, a user typically initiates operation of washing machine 74 by activating switch 76 to a desired operating mode, at which time electrical current passes through electrical wire 82. Relay 80 (preferably placed in fuse box 88 (of FIG. 2)) immediately detects operation of washing machine 74 and initiates hot water recirculation through line 20. Hence, hot water recirculation commences as soon as a user turns on washing machine 74.

As identified by the various hot water fixtures in FIG. 1, operation of switches 44 and 65 and switches 48 and 76 each individually trigger hot water recirculation through line 20 without requiring that a user activate a separate, dedicated switch within the respective room. In each of these cases, the user is already required to activate the respective switch in association with utilizing the related, or associated, hot water fixture. For example, a user will normally be required to turn on an overhead light within a kitchen before using sink 40 and activating hot water faucet 52 to deliver hot water into sink 40. Likewise, a user will be required to activate switch 65 in order to turn on a bathroom light so that they can see before activating hot water faucet 66 within sink 56. Similarly, a user will activate switch 65 in order to use shower 60 and thereby activate hot water recirculation through line 20 before actual actuation of hot/cold water faucet 70 of shower 60. Finally, a user will typically be required to turn on washing machine 74 before initiating operation of a washing machine cycle.

In this manner, a user does not have to remember to activate a separate, dedicated switch in order to initiate hot water recirculation through line 20 within a house or building. Likewise, existing wiring can be utilized to trigger detection of a need to recirculate hot water within line 20 by merely utilizing relays 47, 50, 64 and 80. These relays each detect current flow through existing electrical wires that provide independent power functions within the building that are associated with utilization of the rooms in which the desired hot water fixtures are to be used.

For the case of clothes washing machine 74, an optional configuration entails providing relay 80 configured about an electrical wire that supplies power to an overhead light for laundry room 16. Where laundry room 16 is used solely for washing and drying clothes, utilization of relay 80 on the respective light switch will trigger hot water recirculation through line 20 immediately when a user turns on the respective light switch. Accordingly, hot water recirculation will be initiated earlier in time, even before a user has had a chance to turn on switch 76. Likewise, dishwasher 42 can utilize the benefits of hot water recirculation that are triggered solely by activation of switch 44, and relay 50 optionally can be eliminated for cases where it is believed that a user will turn on light switch 44 prior to each time they initiate a washing cycle using dishwasher 42.

For the case of relays 47, 50, 64, and 80, each relay ties into power that is going to a respective light switch or appliance in order to activate hot water recirculation in line 20 via pump 30. It is understood that the respective relays can be configured to be activated by either 110, 220, or 440 volts, depending on the voltage of the respective circuit being monitored.

For the optional case where a thermal switch 36 is incorporated into the design of system 10, thermal switch 36 can be used to shut down operation of pump 30 once thermal switch 36 detects a sufficiently high temperature within the downstream end of the closed loop provided by line 20. Switch 36 can be further configured to restart pump 30 in the event that the detected downstream temperature in line 20 falls sufficiently below a desired threshold setpoint temperature. However, this will only occur as long as one of relays 47, 50, 64, and 80 is still detecting current flow associated with operation of the respective electrical appliance which would indicate a need for hot water recirculation through line 20.

According to one construction, thermal switch 36 is preferably placed adjacent hot water tank 38, but is sufficiently spaced far enough away from hot water tank 38 so that switch 36 is not heated by tank 38. For example, oftentimes hot water tank 38 is placed within a heated room. In such case, preferably thermal switch 36 is placed just outside such heated room in order to more accurately detect the true downstream temperature of water within line 20.

In operation, the downstream section of the return hot water line 20 will cool down much more slowly than the remaining hot water line 20 that serves the remaining upstream portion of the house. This is particularly true if the piping used to form hot water line 20 is present within a crawl space of the home. In the alternative, if thermal switch 36 is placed in a heated portion of the house, system 10 may not heat up water in the cooler downstream portion of line 20. More particularly, the thermal switch (or temperature sensor) 36 that is present in the heated area will indicate a higher temperature than would be required by the setpoint temperature in order to trigger switch 36 to activate operation of pump 30.

System 10 provides one benefit in that there is no need for special switches or special wiring to be placed within a residential home or building at the time of construction. Instead, existing switches that are dedicated to other purposes, but which are associated with utilization of the respective hot water fixture, are monitored using a relay to detect current flow and to thereby trigger associated hot water recirculation for the respective hot water fixture. For the case of existing home or building construction, if existing wiring does not allow for appliances or light switches to be placed onto their own dedicated circuits, then a relay can be installed at the end of the circuit being used to detect and trigger hot water recirculation.

As was shown with respect to bathroom 14 in FIG. 1, relay 64 is activated by a user turning on an overhead bathroom light. Alternatively, the relay can be used to detect current flow in an electrical wire for an overhead ventilation fan provided within the bathroom.

For the case of kitchen 12, relay 47 is activated by the use of overhead light switch 44, which is placed adjacent to sink 40. For the case of dishwasher 42 in kitchen 12, relay 50 can be configured to detect current flow through electrical wire 50 that delivers power to the power circuit for the dishwasher 42. Alternatively, relay 50 can be a solid state relay that is configured to attach directly to power circuitry for dishwasher 42.

Similarly, clothes washer 74 in laundry room 16 uses a similar relay 80 configured to detect current flow through electrical wire 82 that supplies power to power circuitry for clothes washer 74. Alternatively, the solid state relay can be attached directly to power circuitry for the clothes washer in order to detect the turning on of power to clothes washer 74 at the initiation of a wash cycle. Further optionally, a switch can be provided when the door is opened on either of dishwasher 42 or washing machine 74 which sends an electrical signal that is detected by a relay and which initiates activation of the recirculation hot water pump 30 to start recirculation through line 20 upon opening of the respective door.

Figure 2:
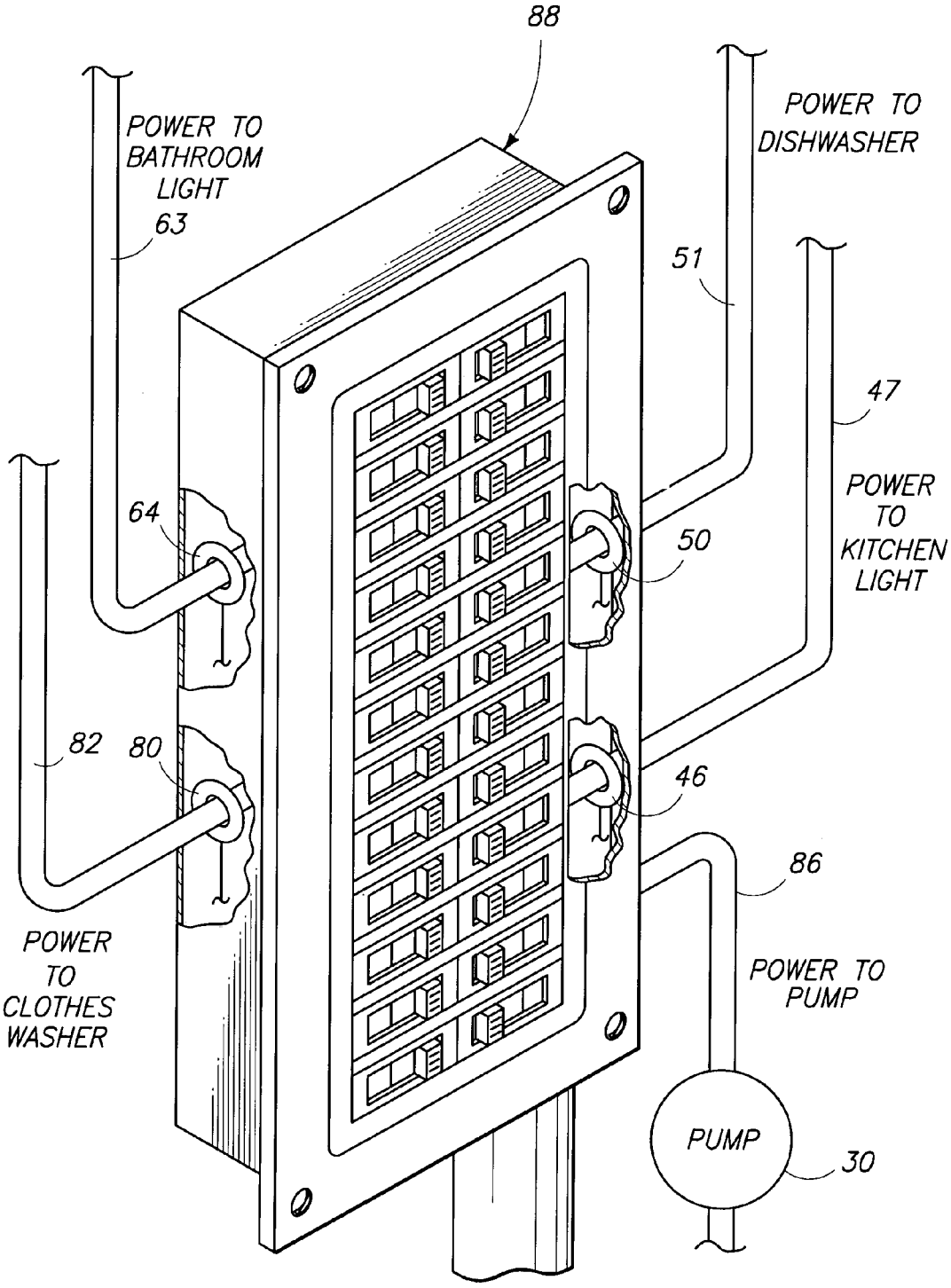
FIG. 2 is a simplified perspective view of a circuit breaker box into which relay current sensors are provided to detect operation of power circuits associated with a respective hot water fixture.

FIG. 2 illustrates a preferred technique for detecting operation of an electrical circuit proximate a hot water fixture and associated with a user operating the fixture. More particularly, relays 46, 50, 64 and 80 are provided in association with electrical wires 47, 51, 63 and 82, respectively, to detect current flow through the respective electrical wires. The detection of current flow indicates that a user has initiated operation of an electrical circuit proximate the respective hot water fixture. This signals a need to initiate hot water recirculation in line 20.

In the present case, relays 46, 50, 64 and 80 are mounted inside the housing of fuse box 88, adjacent the respective fuses. Alternatively, relays 46, 50, 64 and 80 can be provided anywhere along the length of electrical wires 47, 51, 63 and 82 as they extend to the respective light switch or switch on the electrical device that is consuming power and for which hot water is needed.

As shown in FIG. 2, relays 46, 50, 64 and 80 are shown installed within a main electrical panel of a fuse box 88. Each relay comprises a current sensor that is wrapped around a power leg for a circuit that supplies power to an overhead light or power circuitry a dishwasher or a clothes washer. Depending on the electrical code for the area in which the system is being implemented, many devices can be run on one circuit, as is the case for the devices present within the bathroom 14 of FIG. 1.

Also depending on the electrical circuit and the respective electrical codes in the region, a less expensive relay can be implemented without using a doughnut-type relay, but using a direct connection to an electrical contact of the respective electrical circuit. Accordingly, a solid state relay can be utilized.

As shown in FIG. 2, all of relays 46, 50, 64 and 80 are tied into an electrical power supply wire 86 for pump 30. When none of relays 46, 50, 64 and 80 detect power through the respective electrical wires, all four relays are in an open position (as each relay acts as an on/off switch), which is configured to short out electrical wire 86 and cut off power supply to pump 30. In the event that any one of the relays detects current flow through the respective electrical wires, the short in electrical wire 86 is shunted and power is delivered to pump 30 in order to operate pump 30 and initiate hot water recirculation to the system.

According to one construction, a suitable relay comprises a current sensor-start/stop relay, such as a Model No. RIBX-LCA, sold by Functional Devices, Inc., 310 S. Union Street, Russiaville, Ind. 46979. Such sensor is operative to detect both alternating current (AC) and direct current (DC). Another suitable relay, also sold by Functional Devices, Inc., comprises a Model No. RIBU1C. Alternatively, any of a number of doughnut-type solid state relays can be utilized. Further alternatively, mechanical relays (which are less expensive) may be suitable for certain applications, but can be susceptible to switch bounce, which makes them less desirable for applications requiring frequent changes of state. In addition to using a relay, any form of solid state switch that is capable of detecting current flow through an existing electrical circuit can be utilized to detect the need to initiate hot water recirculation.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A hot water recirculation system, comprising a source of hot water;

a fixture remote from the source and configured to dispense hot water;

a fluid circuit extending from the source to the fixture for delivering hot water to the fixture, and returning to the source for recirculating hot water in the fluid circuit back to the source for reheating;

a fluid pump for recirculating hot water through the fluid circuit; and an electrical circuit sensor magnetically coupled with an electrical circuit that is proximate the fixture and configured to detect operation of the electrical circuit without electrically connecting to and drawing power directly from the electrical circuit and corresponding with a user operating the fixture, and is further configured to initiate operation of the fluid pump responsive to detected operation of the electrical circuit to initiate hot water recirculation.

2. The hot water recirculation system of claim 1 wherein the source of hot water comprises a hot water tank and heater.

3. The hot water recirculation system of claim 1 wherein the fixture comprises a bathroom hot water fixture and the electrical circuit sensor is configured to sense current flow through a bathroom light circuit responsive to a user turning on a light of the light circuit.

4. The hot water recirculation system of claim 3 wherein the bathroom fixture comprises a sink hot water faucet.

5. The hot water recirculation system of claim 3 wherein the fixture comprises a shower/tub hot water faucet.

6. The hot water recirculation system of claim 1 wherein the fixture comprises a kitchen hot water faucet and the electrical circuit sensor is configured to sense current flow through a kitchen light circuit responsive to a user turning on a light of the light circuit.

7. The hot water recirculation system of claim 1 wherein the electrical circuit sensor comprises a relay associated with an electrical wire of the electrical circuit.

8. The hot water recirculation system of claim 7 wherein the relay is a solid state doughnut-type relay that encircles the electrical wire.

9. The hot water recirculation system of claim 8 wherein the relay is mounted within a fuse box electrical panel.

10. The hot water recirculation system of claim 1 further comprising a check valve provided in the fluid circuit to impart one-way fluid flow through the fluid circuit.

11. The hot water recirculation system of claim 1 wherein the source of hot water comprises a hot water tank, the fluid circuit extends from a hot water outlet port of the hot water tank alongside a plurality of fixtures, through the fluid pump, and back to a water inlet port of the hot water tank.

12. The hot water recirculation system of claim 11 further comprising a pair of shutoff valves provided on either side of the fluid pump and configured to isolate the fluid pump to enable maintenance, repair and/or removal of the fluid pump from along a fluid circuit.

13. The hot water recirculation system of claim 1 further comprising a main water supply line entering the fluid circuit upstream of the source of hot water and downstream of the fluid pump, and further comprising a check valve provided in the main water supply line to prevent introduction of recirculated hot water back into the main water supply line from the fluid circuit.

14. The hot water recirculation system of claim 7 wherein the relay is configured to detect operation of an electrical power supply wire to a dishwashing machine.

15. The hot water recirculation system of claim 7 wherein the relay is configured to detect operation of an electrical power supply wire to a clothes washing machine.

16. A system for initiating hot water recirculation, comprising:

a hot water tank communicating with a device for heating water;

a hot water fixture disposed from the hot water tank and configured to dispense hot water to a user;

a hot water fluid conduit comprising a hot water pipe loop extending from the hot water tank to the fixture and back to the hot water tank to enable passage of hot water in a single direction through the fluid conduit to the fixture and back to the hot water tank for reheating;

a hot water pump disposed in the fluid conduit downstream of the fixture and proximate the hot water tank and configured to recirculate hot water through the fluid conduit and back into the hot water tank for reheating; and an electrical power relay magnetically coupled via mutual induction without direct electrical connection to an electrical power circuit for a fixture and provided in electrically non-invasive relationship with the electrical power circuit, configured to detect current flow through the electrical power circuit for the fixture which is provided proximate and associated with the hot water fixture, and further configured to initiate power delivery to the hot water pump responsive to the relay detecting operation of current flow through the electrical circuit to initiate hot water recirculation.

17. The system of claim 16 wherein the relay is provided on a kitchen light switch and the hot water fixture comprises a hot water faucet of a kitchen sink.

18. The system of claim 16 wherein the fixture comprises a hot water faucet in a bathroom sink, the relay is configured to detect current flow of an electrical wire between a bathroom light switch and an electrical panel.

19. The system of claim 16 wherein the fixture comprises a hot/cold water faucet of a shower, and the relay is configured to detect current flow of an electrical wire between a bathroom light switch and a supply of electricity.

20. The system of claim 16 wherein the hot water fixture comprises a hot water supply line to a dishwasher, and the relay is configured to detect current flow through an electrical wire supplying power to the dishwasher.

21. The system of claim 16 wherein the hot water fixture comprises a hot water supply to a clothes washer, and the relay is configured to detect current flow through an electrical wire supplying power to the clothes washer.

22. A method for recirculating hot water through a continuous loop fluid circuit, comprising:

providing a source of hot water disposed within a continuous loop fluid conduit with at least one fixture disposed along the fluid conduit;

detecting operation of an electrical circuit proximate the fixture and associated with a user operating the fixture using magnetic coupling and without forming a direct electrical connection with the circuit; and in response to detecting operation of the electrical circuit, recirculating hot water through the fluid conduit.

23. The method of claim 22 wherein detecting operation of an electrical circuit comprises detecting current flow through an electrical wire of a light switch circuit.

24. The method of claim 22 wherein detecting operation of an electrical circuit comprises detecting current flow through a power supply wire to an electrical appliance.

25. The method of claim 22 wherein detecting operation of an electrical circuit comprises detecting current flow through an electrical wire using a relay provided in association with the electrical wire.

* * * * *